US005747947A

United States Patent [19]

Hak

[11] Patent Number: 5,747,947

[45] Date of Patent: May 5, 1998

[54] GAIN CONTROLLED CONTROL SIGNAL BASED ON SENSED LAMP CURRENT

[75] Inventor: Moon Seong Hak, Seoul, Rep. of Korea

[73] Assignee: LG Electronics Inc., Seoul, Rep. of Korea

[21] Appl. No.: 515,225

[22] Filed: Aug. 15, 1995

[30] Foreign Application Priority Data

Aug. 25, 1994 [KR] Rep. of Korea ..... 94 21076

[51] Int. Cl.[6] ..... H05B 37/02

[52] U.S. Cl. ..... 315/308; 315/DIG. 5; 315/DIG. 7

[58] Field of Search ..... 315/307, 308, 315/82, DIG. 5, DIG. 7

[56] References Cited

U.S. PATENT DOCUMENTS 5,449,973 9/1995 Yamashita et al. ..... 315/308

*Primary Examiner*—Robert Pascal
*Assistant Examiner*—Michael Shingleton
*Attorney, Agent, or Firm*—John P. White; Cooper & Dunham LLP

[57] ABSTRACT

A multi-output circuit for projection TV lamp is disclosed including a DC/DC-voltage converter, a voltage dividing portion, a driving pulse generator for generating a driving pulse, a lamp driving portion for switching the output voltage of the DC/DC-voltage converter, a voltage feeding-back portion for comparing the output voltage of the voltage dividing portion with a reference voltage, a current feeding-back portion for comparing the driving current supplied to the lamp with the reference voltage, a current detecting portion for detecting the driving current supplied to the lamp, an error amplifying portion for comparing the output voltage output from the current detecting portion, a gain controller for summing the output voltages of the voltage feeding-back portion and current feeding-back portion, and a pulse-width modulation integrated device for outputting a pulse-width modulation signal to the DC/DC-voltage converter.

20 Claims, 4 Drawing Sheets

GAIN CONTROLLED CONTROL SIGNAL BASED ON SENSED LAMP CURRENT

BACKGROUND OF THE INVENTION

The present invention relates to a multi-output circuit for a projection TV lamp, and more particularly, to a multi-output circuit for a projection TV lamp for driving lamps of different capacities in such a manner that the current of lamps is detected to control its gain.

FIG. 1 is a driving circuit of stabilizer for a general projection TV lamp. Referring to FIG. 1, the stabilizer driving circuit includes a DC/DC-voltage converter 1 for converting an input DC-voltage Vdc into the driving level of lamp, a voltage dividing portion 8 formed with two resistors R101 and R102 serially connected to DC/DC-voltage converter 1 so as to divide the output voltage of DC/DC-voltage converter 1, a driving pulse generator 3 for generating a driving pulse for driving the lamp, a lamp driving portion 2 for switching the output voltage of DC/DC-voltage converter 1 according to the driving pulse supplied from driving pulse generator 3, and alternately supplying the voltage forward or reversely to drive the lamp, a voltage feeding-back portion 4 for comparing the voltage output from voltage dividing portion 8 with a reference voltage, a current feeding-back portion 5 for comparing the current flowing the lamp through lamp driving portion 2 with the reference voltage, an error amplifying portion 6 formed with an operation amplifier OP and for summing the output voltages of voltage feeding-back portion 4 and current feeding-back portion 5 and comparing the result with the reference voltage, and a pulse-width modulation integrated device 7 for outputting a pulse-width modulation signal to DC/DC-voltage converter 1 according to the output voltage of error amplifying portion 6.

The operation of the stabilizer driving circuit for a general projection TV lamp will be described below.

When DC power Vdc is input to DC/DC-voltage converter 1, an internal transformer is driven for a predetermined period according to the pulse-width modulation signal output from pulse-width modulation integrated device 7, and the ON time of DC/DC-voltage converter 1 is varied to output a voltage converted into the driving level of the lamp. In other words, a voltage corresponding to the pulse width of the pulse-width modulation signal output from pulse-width modulation integrated device 7 is output to DC/DC-voltage converter 1. Here, two pairs of transistors incorporated in lamp driving portion 2 are driven in a push-pull fashion according to the driving pulse, that is, a base driving pulse, output from driving pulse generator 3.

One pair of transistors are turned on at the same time according to the base driving pulse output from driving pulse generator 3. Through the pair of transistors and lamp, the driving current flows to light the lamp. After the lamp is ON, the other pair of transistors are turned on simultaneously according to the base driving pulse output from driving pulse generator 3. Through those transistors and the lamp, the driving current of the lamp flows reversely to maintain the lighting of the lamp. Here, the output voltage of DC/DC-voltage converter 1 is divided into predetermined levels through resistors R101 and R102 of voltage dividing portion 8, and input to voltage feeding-back portion 4 so that the divided voltages are compared with the reference voltage. The current flowing through the lamp via lamp driving portion 2 is input to current feeding-back portion 5 and compared with the reference voltage.

The outputs of voltage feeding-back portion 4 and current feeding-back portion 5 are summed in operation amplifier OP of error amplifying portion 6, compared with the reference voltage, and supplied to pulse-width modulation integrated device 7. The output supplied is used to generate the pulse-width modulation signal.

The voltage output and fed-back from error amplifying portion 6 through the above-stated path is input to pulse-width modulation integrated device 7 so as to control the pulse-width modulation signal. By doing so, the level of the voltage output from DC/DC-voltage converter 1 can be converted into the driving level of the lamp, constantly maintaining the light output of the lamp.

However, in the general stabilizer driving circuit for projection TV lamp, the driving output of the lamp is fixed at one output so that, in case that a lamp of different capacity is used, a stabilizer driving circuit for generating a corresponding driving output must be separately used, which is deficient in wide-range utility.

SUMMARY OF THE INVENTION

Therefore, it is an object of the present invention to provide a multi-output circuit, in projection TV lamps, for driving lamps of different capacities, using a single lamp driving device, in such a manner that the current of the lamp is detected to control its gain.

To accomplish the object of the present invention, there is provided one embodiment of a multi-output circuit for projection TV lamp comprising: a DC/DC-voltage converter for converting an input DC voltage into the driving level of a lamp; a voltage dividing portion for dividing the output voltage of the DC/DC-voltage converter into predetermined levels; a driving pulse generator for generating the driving pulse for driving the lamp; a lamp driving portion for switching the output voltage of the DC/DC-voltage converter according to the driving pulse output from the driving pulse generator so as to alternately supply a driving power to the lamp forward or reversely; a voltage feeding-back portion for comparing the output voltage of the voltage dividing portion with a reference voltage, and feeding back the output to a power input stage; a current feeding-back portion for comparing the driving current supplied to the lamp with the reference voltage so as to feed back the current to the power input port; a current detecting portion for detecting the driving current supplied to the lamp so as to output a voltage corresponding thereto; an error amplifying portion for comparing the output voltage output from the current detecting portion so as to differentially amplifying the voltage; a gain controller for summing the output voltages of the voltage feeding-back portion and current feeding-back portion, and attenuating the result according to the output voltage level of the error amplifying portion; a pulse-width modulation integrated device for outputting a pulse-width modulation signal to the DC/DC-voltage converter according to the output voltage of the gain controller so as to vary the output of the lamp.

For the object of the present invention, there is provided another embodiment of a multi-output circuit for projection TV lamp comprising: a lamp output detecting portion for detecting the output voltage of a lamp, and outputting a voltage corresponding thereto; an amplifying portion for comparing the output voltage output from the lamp output detecting portion with a reference voltage, and differentially amplifying the voltage; a DC/DC-voltage converter for converting an input DC voltage into the driving level of the lamp; a voltage dividing portion for dividing the output voltage of the DC/DC-voltage converter into predetermined levels; a driving pulse generator for generating the driving pulse for driving the lamp; a lamp driving portion for switching the output voltage of the DC/DC-voltage converter according to the driving pulse output from the driving pulse generator so as to alternately supply a driving power to the lamp forward or reversely; a voltage feeding-back portion for comparing the output voltage of the voltage dividing portion with a reference voltage, and feeding back the output to a power input stage; a current feeding-back portion for comparing the driving current supplied to the lamp with the reference voltage so as to feed back the current to the power input port; a lamp output controller for increasing or decreasing the output current of the lamp according to the output level of the amplifying portion so as to change the output voltage and driving current of the voltage dividing portion 32 input to the voltage feeding-back portion and current feeding-back portion from the lamp driving portion; an error amplifying portion for comparing the output voltage output from the current detecting portion so as to differentially amplifying the voltage; and a pulse-width modulation integrated device for outputting a pulse-width modulation signal to the DC/DC-voltage converter according to the output voltage of the gain controller so as to vary the output of the lamp.

BRIEF DESCRIPTION OF THE ATTACHED DRAWINGS

DETAILED DESCRIPTION OF THE INVENTION

Figure 1:
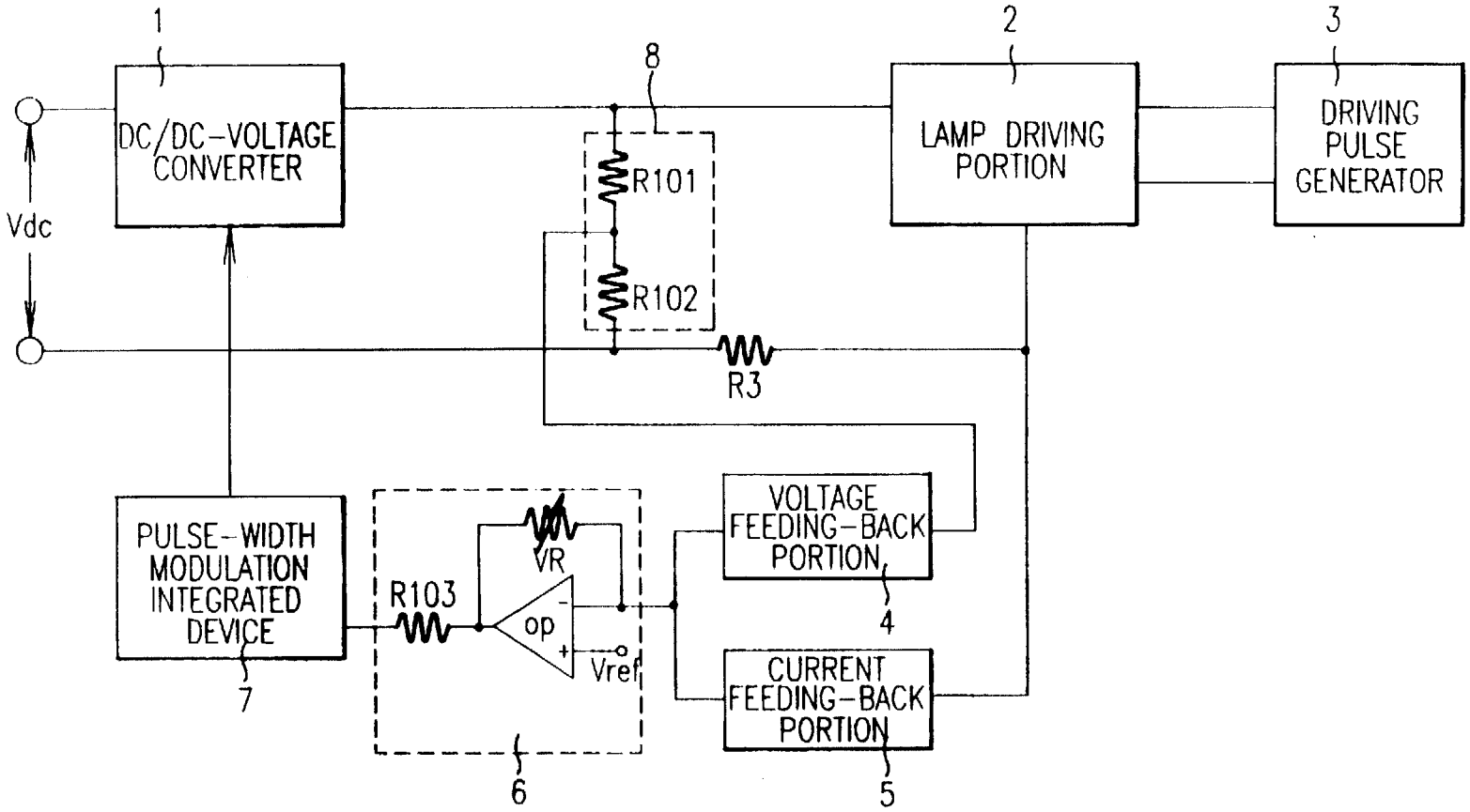
FIG. 1 is a block diagram of a stabilizer for a general projection TV lamp.
Figure 2:
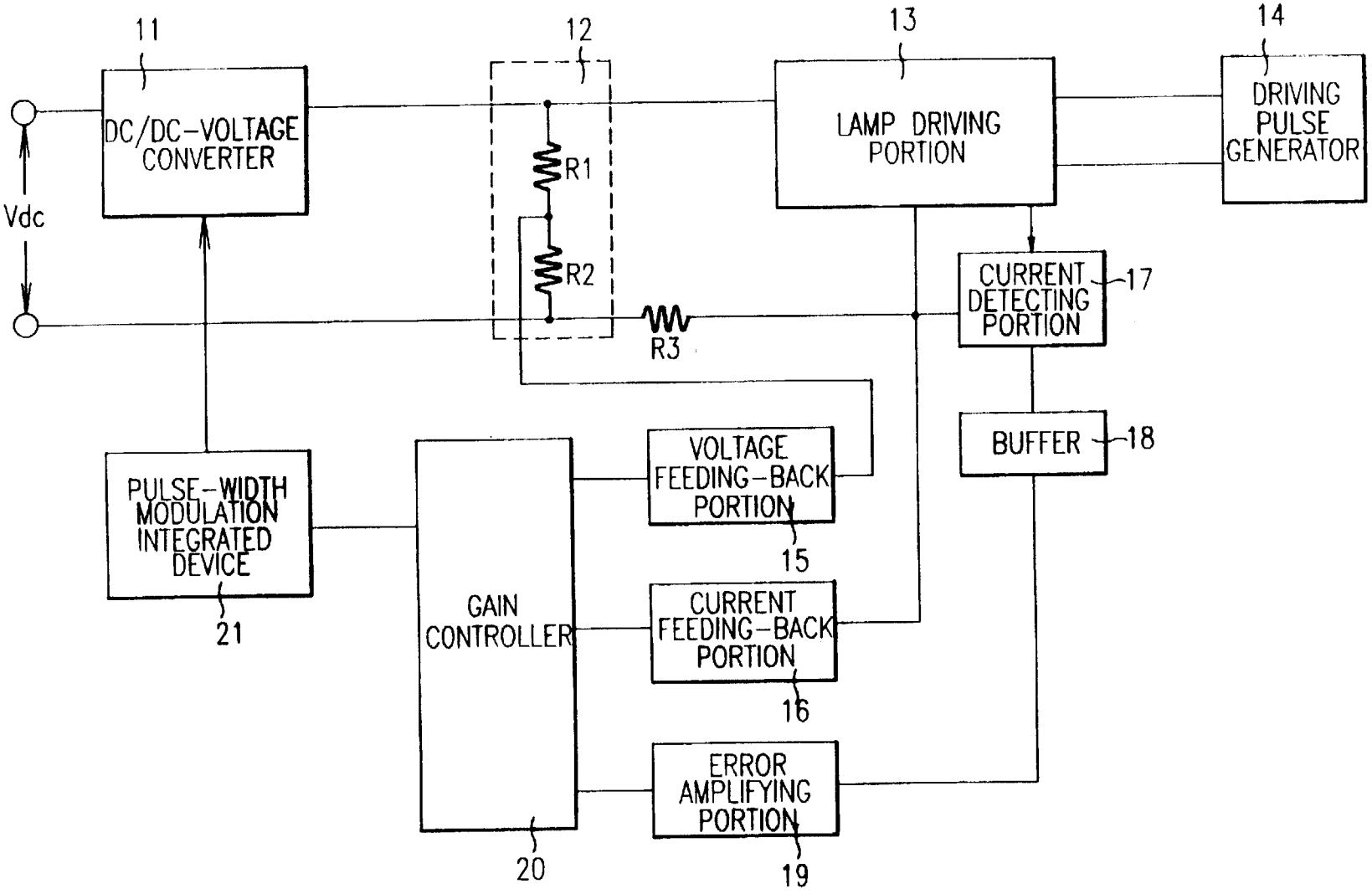
FIG. 2 is a block diagram of one embodiment of a multi-output circuit for projection TV lamp of the present invention.
Figure 3:
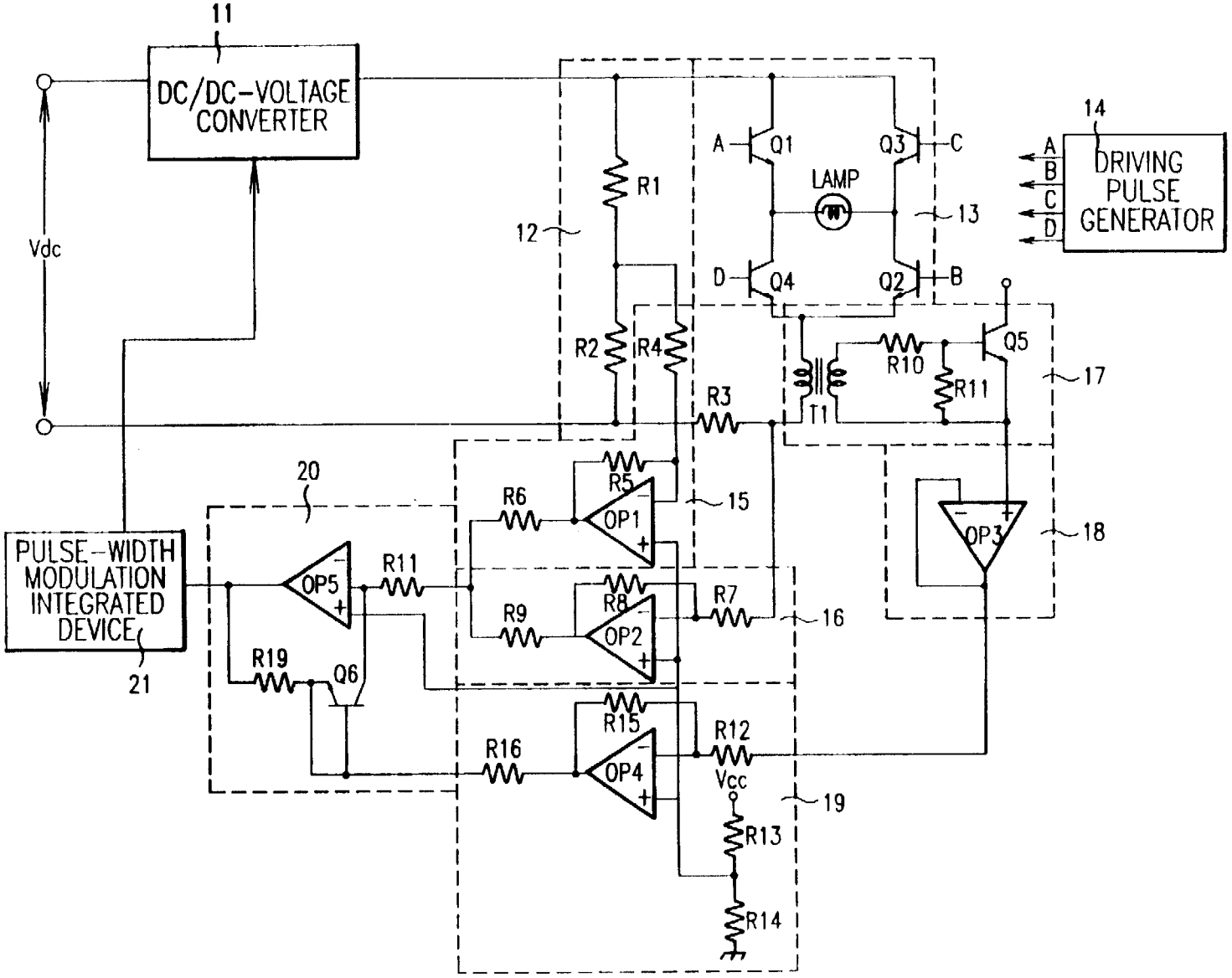
FIG. 3 is a circuit diagram of the first embodiment of the multi-output circuit for projection TV lamp of the present invention.

Referring to FIGS. 2 and 3, one embodiment of the multi-output circuit for projection TV lamp of the present invention comprises a DC/DC-voltage converter 11, voltage dividing portion 12, lamp driving portion 13, driving pulse generator 14, voltage feeding-back portion 15, current feeding-back portion 16, current detecting portion 17, buffer 18, error amplifying portion 19, gain controller 20, and pulse-width modulation integrated device 21.

DC/DC-voltage converter 11 converts an input DC voltage Vdc into the driving level of a lamp. Voltage dividing portion 12 divides the output voltage of DC/DC-voltage converter 11 into predetermined levels, including resistors R1 and R2 serially connected to the output stage of DC/DC-voltage converter 11. Driving pulse generator 14 generates the driving pulse for driving the lamp, and outputs it to lamp driving portion 13. Lamp driving portion 13 switches the output voltage of DC/DC-voltage converter 11 according to the driving pulse output from driving pulse generator 14 so as to alternately supply a driving power to the lamp forward or reversely. The lamp driving portion is constructed in such a manner that according to the driving pulse output from driving pulse generator 14, two pairs of transistors Q1, Q2, G3 and G4 are driven in a push-pull fashion.

Voltage feeding-back portion 15 compares the output voltage of voltage dividing portion 12 with the reference voltage, and feeds back the output to the power input stage. The voltage feeding-back portion comprises an operation amplifier OP1 for comparing the output voltage output from voltage dividing portion 12 through resistor R4 with the reference voltage so that the voltage corresponding to their difference is output to gain controller 20, resistor R5 coupled to the inverted input port and output port of operation amplifier OP1, and resistor R6 coupled to the output port of operation amplifier OP1 and to the input port of gain controller 20.

Current feeding-back portion 16 compares the driving current supplied to the lamp with the reference voltage so as to feed back the current to the power input port. The current feeding-back portion comprises a resistor R7 for receiving the driving current supplied to the lamp through resistor R3, operation amplifier OP2 for comparing the current supplied through resistor R7 with the reference voltage so that the voltage corresponding to their difference is output to gain controller 20, resistor R8 coupled to the inverted input port and output port of operation amplifier OP2, and resistor R9 coupled to the output port of operation amplifier OP2 and to the input port of gain controller 20.

Current detecting portion 17 detects the driving current supplied to the lamp so as to output a voltage corresponding thereto. The current detecting portion comprises a transformer T1 for detecting the driving current supplied to the lamp from lamp driving portion 13, resistors R10 and R11 for dividing the voltage induced to the secondary coil of transformer T1 into predetermined levels so as to supply a bias voltage, and transistor Q5 for outputting a voltage corresponding to the bias voltage supplied via resistors R10 and R11.

Error amplifying portion 19 compares the output voltage output via buffer 18 from current detecting portion 17 so as to differentially amplifying the voltage. The error amplifying portion comprises an operation amplifier OP4 for comparing the output voltage output from current detecting portion 17 via buffer 18 and resistor R12 so as to output a voltage corresponding to their difference, resistor R15 coupled to the inverted input port and output port of operation amplifier OP4, and resistor R16 coupled to the output port of operation amplifier OP4 and the input port of gain controller 20. Here, the reference voltage is generated by resistors R13 and R14 serially connected to power Vcc and the ground, and supplied to the non-inverted input port of operation amplifiers OP1, OP2 and OP4.

Gain controller 20 sums the output voltages of voltage feeding-back portion 15 and current feeding-back portion 16, and attenuates the result according to the output voltage level of error amplifying portion 19. The gain controller comprises an operation amplifier OP5 for comparing the output voltages of voltage feeding-back portion 15 and current feeding-back portion 16 received via resistor R11 with the reference voltage so as to output a voltage corresponding to their difference, and a transistor Q6 for attenuating the input voltage of operation amplifier OP5 in proportion with the output voltage level of error amplifier 19, and for outputting the result to pulse-width modulation integrated device 21 via resistor R19.

Pulse-width modulation integrated device 21 outputs the pulse-width modulation signal to DC/DC-voltage converter 1 according to the output voltage of gain controller 20 so as to vary the output of the lamp. Buffer 18 buffers and amplifies the output voltage of current detecting portion 17 so as to output it to error amplifying portion 19, comprising an operation amplifier OP3 for buffering and amplifying the output voltage of current detecting portion 17 which is then output to error amplifier 19.

The operation of the first embodiment of a multi-output circuit for projection TV lamp will be described below.

When input DC/DC-voltage Vdc is input to DC/DC-voltage converter 11, a transformer incorporated in DC/DC-voltage converter 11 is driven for a predetermined period according to the pulse-width modulation signal output from pulse-width modulation integrated device 21. Accordingly, the output ON time of DC/Dc-voltage converter 11 is varied to output a voltage corresponding to the pulse-width modulation signal from DC/DC-voltage converter 11. Here, transistors Q1, Q2, Q3 and Q4 of lamp driving portion 13 are driven in the push-pull fashion by base driving pulses A, B, C and D output from driving pulse generator 14

Because a pair of transistors Q1 and Q2 are turned on at the same time by base driving pulses A and B output from driving pulse generator 14, the driving current of the lamp flows through transistor Q1, the lamp and transistor Q2 so that the lamp is turned on. Another pair of transistors Q3 and Q4 are turned on at the same time by base driving pulses C and D output from driving pulse generator 14 so that the driving current of the lamp flows through transistor Q3, the lamp and transistor Q4, maintaining the lighting of the lamp.

Here, the voltage output from DC/DC-voltage converter 11 to lamp driving portion 13 is divided in a predetermined ratio by resistors R1 and R2, and supplied to operation amplifier OP1 of voltage feeding-back portion 15 via resistor R4. The voltage supplied is compared with the reference voltage so that a voltage corresponding to the feeding-back voltage is output.

The driving current supplied to the lamp via lamp driving portion 13 is fed to operation amplifier OP2 of current feeding-back portion 16, and compared with the reference voltage. By doing so, a voltage corresponding to the feeding-back current is output.

The output voltages of operation amplifiers OP1 and OP2 are summed via operation amplifier OP5 of gain controller 20, and supplied to pulse-width modulation integrated device 21. Pulse-width modulation integrated device 21 inverts the voltage fed-back via the above-mentioned path so that the output pulse-width is controlled according to the inverted output waveform, constantly maintaining the light output of the lamp. The above description is about the general operation of driving a lamp, in which a corresponding driving output is supplied whenever the capacity of the lamp is varied according to the first embodiment. For instance, the process of generating a driving output in case that a lamp of 150 W is exchanged with a lamp of 250 W will be explained below.

When the lamp of 150 W is used, driving current of 1.8 A is supplied to the lamp. In case of lamp of 250 W, driving current of 3.8 A is supplied to the lamp. The driving current increased is detected through transformer T1 and supplied to the base of transistor Q5.

When the lamp of 250 W is used as compared with the lamp of 150 W, the current supplied to the base of transistor Q5 is increased so that the level of the voltage output from current detecting portion 17 is increased accordingly.

The voltage output from current detecting portion 17 is buffered and amplified through buffer 18, and supplied to the non-inverted input port of operation amplifier OP4 in the error amplifier. The voltage is compared with the reference voltage supplied to the inverted input port.

In case that the lamp of 250 W is used, a higher voltage than the lamp of 150 W is supplied to operation amplifier OP4. For output voltage, in case of the lamp of 250 W, a higher voltage than the lamp of 150 W is output from operation amplifier OP4.

The voltage in which the bias voltage of transistor Q6 is increased to be supplied to the non-inverted input port of operation amplifier OP5 from operation amplifiers OP1 and OP2 is reduced more, via transistor Q6, in case of the lamp of 250 W than of the lamp of 150 W. Therefore, in case of the lamp of 250 W, the output voltage of operation amplifier OP5 is relatively reduced sharply, as compared with the lamp of 150 W.

Pulse-width modulation integrated device 21 inverts the voltage output from operation amplifier OP5, and outputs the pulse-width modulation signal corresponding to the inverted voltage. DC/DC-voltage converter 11 generates the driving output of the 150 W-lamp and then the driving output of the 250 W-lamp.

Comparing the 150 W-lamp and 250 W-lamp, the current of the 150 W-lamp is 1.8 A, which is less than 3.8 A of the current of the 250 W-lamp. This is because the current of the 150 W-lamp becomes smaller than that of the 250 W-lamp via the output of buffer 18 and error amplifier 19. For this reason, in turning on transistor Q6 of pulse-width modulation controller 20, the bias voltage becomes low so that the current flows less. The output of pulse-width modulation controller 20 is that the output of error amplifying portion 19 is added to the outputs of voltage feeding-back portion 15 and current feeding-back portion 16. The gain, the output of pulse-width modulation controller 20, of the 150 W-lamp becomes higher than that of the 250 W-lamp.

For the 250 W-lamp, the output of error amplifying portion 19 becomes higher than for the 150 W-lamp. Instead, the output of pulse-width modulation controller 20 is lowered and in turn invertedly amplified in pulse-width modulation integrated device 21. When DC/DC-voltage converter 11 is driven using that, the gain is automatically controlled to generate 150 W of output. Likewise, when the 250 W-lamp is used, the output of 250 W is produced automatically.

In case of a 400 W-lamp, more current flows than for the 150 W-lamp, increasing the output of error amplifying portion 19. Instead, the gain of pulse-width modulation controller 20 is lowered and invertedly amplified in pulse-width modulation integrated device 21. When DC/DC-voltage converter 11 is driven using that, the gain is automatically controlled so that the voltage and current are controlled to be suitable for the 400 W-lamp.

Figure 4:
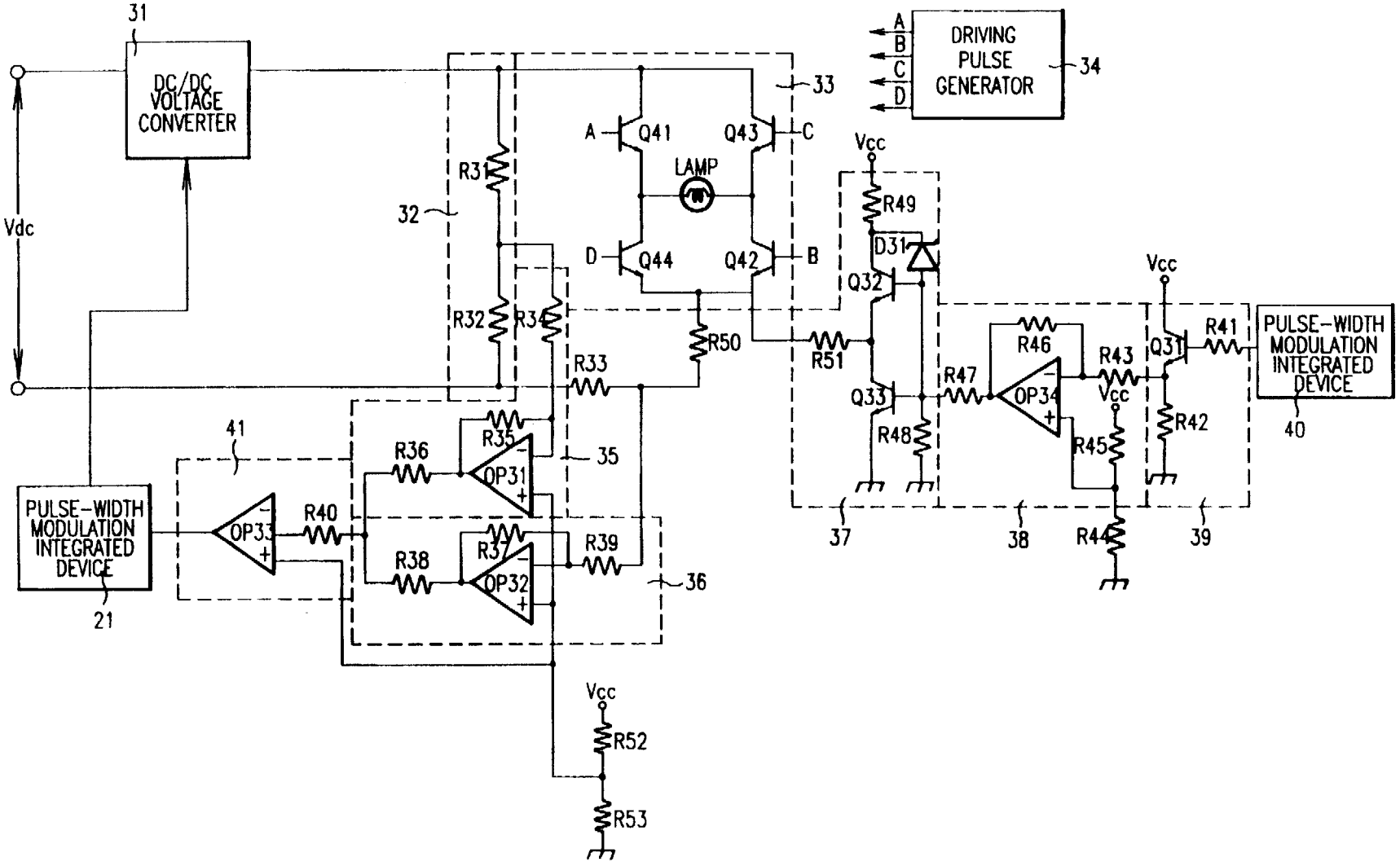
FIG. 4 is a circuit diagram of another embodiment of the multi-output circuit for projection TV lamp of the present invention.

FIG. 4 shows another embodiment of the multi-output circuit for projection TV lamp of the present invention.

Referring to FIG. 4, the second embodiment of the multi-output circuit for projection TV lamp of the present invention comprises a DC/DC-voltage converter 31, voltage dividing portion 32, driving pulse generator 34, lamp driving portion 33, voltage feeding-back portion 35, current feeding-back portion 36, error amplifying portion 41, pulse-width modulation integrated device 42, lamp output detecting portion 40, buffer 39, amplifying portion 38, and lamp output controller 37.

DC/DC-voltage converter 31 converts an input DC voltage Vdc into the driving level of a lamp. Voltage dividing portion 32 divides the output voltage of DC/DC-voltage converter 31 into predetermined levels, including resistors R31 and R32 serially connected to the output stage of DC/DC-voltage converter 31. One end of serially connected resistors R31 and R32 forming voltage dividing portion 32 is coupled to DC/DC-voltage converter 31. The other end thereof is connected to lamp driving portion 33 via resistors R50 and R33. A voltage varied with the output of the lamp and output from lamp driving portion 33 is supplied to voltage feeding-back portion 35 via resistors R50 and R33.

Driving pulse generator 34 generates a driving pulse for driving the lamp, and outputs it to lamp driving portion 33. Lamp driving portion 33 switches the output voltage of DC/DC-voltage converter 31 according to the driving pulse output from driving pulse generator 34 so as to alternately supply a driving power to the lamp forward or reversely. The lamp driving portion is constructed in such a manner that according to the driving pulse output from driving pulse generator 34, two pairs of transistors Q41, Q42, G43 and G44 are driven in the push-pull fashion.

Voltage feeding-back portion 35 compares the output voltage of voltage dividing portion 32 with the reference voltage, and feeds back the output to the power input stage. The voltage feeding-back portion comprises an operation amplifier OP31 for comparing the output voltage output from voltage dividing portion 32 through resistor R34 with the reference voltage so that the voltage corresponding to their difference is output to error amplifying portion 41, resistor R35 coupled to the inverted input port and output port of operation amplifier OP31, and resistor R36 coupled to the output port of operation amplifier OP31 and to the input port of error amplifying portion 41. The voltage feeding-back portion 35 receives the output voltage varied according to the output of the lamp and output from lamp driving portion 33 via resistors R50 and R33 and voltage dividing portion 32, and compares the voltage with the reference voltage.

Current feeding-back portion 36 compares the driving current supplied to the lamp with the reference voltage so as to feed back the current to the power input port. The current feeding-back portion comprises a resistor R39 for receiving the driving current supplied to the lamp through resistor R33, operation amplifier OP32 for comparing the current supplied through resistor R39 with the reference voltage so that the voltage corresponding to their difference is output to error amplifying portion 41, resistor R37 coupled to the inverted input port and output port of operation amplifier OP32, and resistor R38 coupled to the output port of operation amplifier OP32 and to the input port of error amplifying portion 41. Current feeding-back portion 36 receives the driving current of the lamp varied with the output of the lamp and output from lamp driving portion 33 via resistors R50 and R33, and compares it with the reference voltage.

Error amplifying portion 41 sums the output voltages of voltage feeding-back portion 35 and current feeding-back portion 36 so as to compare the result with the reference voltage. The error amplifying portion comprises an operation amplifier OP33 for receiving the output voltages of voltage feeding-back portion 35 and current feeding-back portion 36 via resistor R40 and comparing the input with the reference voltage so as to output a voltage corresponding to their difference. Here, the reference voltage is generated by resistors R52 and R53 serially connected to power Vcc and the ground, and supplied to the non-inverted input port of operation amplifiers OP31, OP32 and OP33.

Pulse-width modulation integrated device 42 outputs the pulse-width modulation signal to DC/DC-voltage converter 41 according to the output voltage of error amplifying portion 41. Lamp output detecting portion 40 detects the output voltage of the lamp, and outputs a voltage corresponding thereto.

Amplifying portion 38 compares the output voltage output from lamp output detecting portion 40 via buffer 39, and differentially amplifies the voltage. The amplifying portion comprises an operation amplifier OP34 for receiving the output voltage of lamp output detecting portion 40 through its inverted input port and buffer 39, and comparing the input with the reference voltage so as to output a voltage corresponding to their difference to lamp output controller 37, resistor R46 coupled to the inverted input port and output port of operation amplifier OP34, and resistor R47 coupled to the output port of operation amplifier OP34 and the input port of lamp output controller 37. Here, the reference voltage input to the non-inverted input port of operation amplifier OP34 is generated by resistors R44 and R45 serially connected to power Vcc and the ground.

Buffer 39 buffers and amplifies the output voltage of lamp output detecting portion 40 so as to output it to amplifying portion 38, comprising a transistor Q31 to whose base the output voltage of lamp output detecting portion 40 is input via resistor R41, whose collector is connected to power Vcc, and whose emitter is coupled to the ground via resistor R42 for the purpose of buffering and amplifying.

Lamp output controller 37 increases or decreases the output current of the lamp according to the output level of amplifying portion 38 so as to change the output voltage and driving current of voltage dividing portion 32 input to voltage feeding-back portion 35 and current feeding-back portion 36 from lamp driving portion 33. Through pulse-width modulation integrated device 42, the output of DC/DC-voltage converter 31 is varied and in turn the output of the lamp is varied.

Here, lamp output controller 37 comprises a Zener diode D31 whose anode is coupled to power Vcc via resistor R49 and whose cathode is coupled to the output port of amplifying portion 38, a transistor Q32 whose collector is coupled via resistor R49, whose base is coupled to the cathode of zener diode D31, and whose emitter is coupled to lamp driving portion 33 via resistor R51, transistor Q33 whose emitter is coupled to the emitter of transistor Q32, whose base is coupled to the output port of amplifying portion 38, and whose collector is coupled to the ground, and resistor R48 connected to the output port of amplifying portion 38 and the ground.

The operation of the second embodiment of a multi-output circuit for projection TV lamp will be described below.

The description of the operation of DC/DC-voltage converter 31, voltage dividing portion 32, lamp driving portion 33, driving pulse generator 34, voltage feeding-back portion 35, current feeding-back portion 36, error amplifying portion 41, and pulse-width modulation integrated device 42 will be omitted because they are the same as those of the general lamp explained before. Explaining lamp output detecting portion 40, buffer 39, amplifying portion 38, lamp current controller 37 in case that a 150 W-lamp and 250 W-lamp are used, the process of supplying a corresponding driving output according to the second embodiment will be described below.

Lamp output detecting portion 40 detects the output of the lamp and outputs a voltage corresponding thereto. To implement that, for instance, the voltage and current of the lamp are detected, the actual output is detected, or the brightness on screen is detected.

In lamp output detecting portion 40, for the 250 W-lamp, a higher voltage is output than for the 150 W-lamp. This voltage is amplified through buffer 39 and amplifying portion 38 and supplied to the base of transistor Q33.

Here, the voltage supplied to transistor Q33 is higher for the 250 W-lamp than for the 150 W-lamp. Thus, the bias is applied low to reduce the amount of current flowing through resistor R51 and transistor Q33. Instead, the amount of current supplied to resistor R50 via transistor Q32 and resistor R51 is increased. Accordingly, the level of the voltage input to voltage feeding-back portion 35 and current feeding-back portion 36 is raised for the 250 W-lamp as compared with for the 150 W-lamp. The voltage supplied from operation amplifiers OP31 and OP32 to the inverted input port of operation amplifier OP33 is raised for the 250 W-lamp as compared with for the 150 W-lamp, decreasing the output voltage of operation amplifier OP33.

Pulse-width modulation integrated device 42 inverts the voltage input from operation amplifier OP33 and outputs the pulse-width modulation signal corresponding to the inverted voltage. In DC/DC-voltage converter 31, the driving output for the 150 W-lamp is generated, and then the driving output for the 250 W-lamp is generated.

As described above, in the present invention, lamps of different capacities can be driven, using a single lamp driving device, in such a manner that the current of the lamp is detected to control its gain. For this reason, when exchanging various lamps of different output capacities, the cost is reduced. In addition, the gain of the lamp is controlled by detecting the output current, implementing constant power.

What is claimed is:

1. A multi-output apparatus for a projection TV lamp comprising:

a DC/DC-voltage converter for converting an input DC voltage into the driving level of a lamp;

a voltage dividing portion for dividing the output voltage of said DC/DC-voltage converter into output voltage 1 (OV1) and output voltage 2 (OV2) at a predetermined ratio;

a driving pulse generator for generating the driving pulse for driving the lamp;

a lamp driving portion for switching the output voltage of said DC/DC-voltage converter according to the driving pulse output from said driving pulse generator so as to alternately supply a driving power to the lamp forward or reversely;

a voltage feeding-back portion for comparing the output voltage OV1 of said voltage dividing portion with a reference voltage, and feeding back the output to a power input stage;

a current feeding-back portion for comparing a driving current supplied to the lamp with the reference voltage so as to feed back the driving current to the power input port;

a current detecting portion for detecting the driving current supplied to the lamp so as to output a voltage corresponding thereto;

an error amplifying portion for comparing the voltage output from said current detecting portion so as to differentially amplify the voltage;

a gain controller comprising: a) an operation amplifier for comparing the output voltages of the voltage feeding-back portion and current feeding-back portion with a reference voltage and outputting a voltage corresponding to their difference and b) a means for attenuating the input voltage of said operation amplifier in proportion with the output voltage level of said error amplifying portion and outputting the result to a pulse-width modulation integrated device; and a pulse-width modulation integrated device for outputting a pulse-width modulation signal to said DC/DC-voltage converter according to the output voltage of said gain controller so as to vary the output of the lamp.

2. A multi-output apparatus for projection TV lamp as claimed in claim 1, further comprising a buffer for buffering and amplifying the output voltage of said current detecting portion so as to output it to said error amplifying portion.

3. A multi-output apparatus for projection TV lamp as claimed in claim 1, wherein said voltage dividing portion includes first and second resistors serially connected to the output stage of said DC/DC-voltage converter.

4. A multi-output apparatus for projection TV lamp as claimed in claim 1, wherein said lamp driving portion is constructed in such a manner that two pairs of transistors are driven in a push-pull fashion according to the driving pulse output from said driving pulse generator.

5. A multi-output apparatus for projection TV lamp as claimed in claim 1, wherein said voltage feeding-back portion comprises an operation amplifier for comparing the output voltage output from said voltage dividing portion with the reference voltage so that the voltage corresponding to their difference is output to said gain controller.

6. A multi-output apparatus for projection TV lamp as claimed in claim 1, wherein said current feeding-back portion comprises an operation amplifier for comparing the current supplied with the reference voltage so that the voltage corresponding to their difference is output to said gain controller.

7. A multi-output apparatus for projection TV lamp as claimed in claim 1, wherein said current detecting portion comprises:

a transformer for detecting the driving current supplied to the lamp;

first and second resistors for dividing the voltage induced to the secondary coil of said transformer into predetermined levels so as to supply a bias voltage; and a transistor for outputting a voltage corresponding to the bias voltage supplied via first and second resistors.

8. A multi-output apparatus for projection TV lamp as claimed in claim 1, wherein said error amplifying portion comprises an operation amplifier for comparing the output voltage output from said current detecting portion so as to output a voltage corresponding to their difference.

9. A multi-output apparatus for projection TV lamp as claimed in claim 1, wherein said gain controller comprises:

an operation amplifier for comparing the output voltages of said voltage feeding-back portion and current feeding-back portion with the reference voltage so as to output a voltage corresponding to their difference; and a transistor for attenuating the input voltage of said operation amplifier in proportion with the output voltage level of said error amplifier.

10. A multi-output apparatus for projection TV lamp as claimed in claim 2, wherein said buffer comprises an operation amplifier for buffering and amplifying the output voltage of said current detecting portion which is then output to said error amplifier.

11. A multi-output apparatus for a projection TV lamp comprising:

a lamp output detecting portion for detecting the output voltage of a lamp, and outputting a voltage corresponding thereto;

an amplifying portion for comparing the voltage output from said lamp detecting portion with a reference voltage, and differentially amplifying the voltage;

a DC/DC-voltage converter for converting an input DC voltage into the driving level of the lamp;

a voltage dividing portion for dividing the output voltage of said DC/DC-voltage converter into output voltage 1 (OV1) and output voltage 2 (OV2) at a predetermined ratio;

a driving pulse generator for generating the driving pulse for driving the lamp;

a lamp driving portion for switching the output voltage of said DC/DC-voltage converter according to the driving pulse output from said driving pulse generator so as to alternately supply a driving power to the lamp forward or reversely;

a voltage feeding-back portion for comparing the output voltage OV1 of said voltage dividing portion with a reference voltage, and feeding back the output to a power input stage;

a current feeding-back portion for comparing a driving current supplied to the lamp with the reference voltage so as to feed back the driving current to the power input port;

a lamp output controller for increasing or decreasing the output current of the lamp according to the output level of said amplifying portion so as to change the output voltage and driving current of said voltage dividing portion input to said voltage feeding-back portion and current feeding-back portion from said lamp driving portion;

an error amplifying portion for comparing the voltage output from said current detecting portion so as to differentially amplify the voltage;

a gain controller comprising: a) an operation amplifier for comparing the output voltages of voltage feeding-back portion and current feeding-back portion with a reference voltage and outputting a voltage corresponding to their difference and b) a means for attenuating the input voltage of said operation amplifier in proportion with the output voltage level of said error amplifying portion and outputting the result to a pulse-width modulation integrated device; and a pulse-width modulation integrated device for outputting a pulse-width modulation signal to said DC/DC-voltage converter according to the output voltage of said gain controller so as to vary the output of the lamp.

12. A multi-output apparatus for projection TV lamp as claimed in claim 11, further comprising a buffer for buffering and amplifying the output voltage of said lamp output detecting portion so as to output it to said amplifying portion.

13. A multi-output apparatus for projection TV lamp as claimed in claim 12, wherein said buffer comprises a transistor to whose base the output voltage of said lamp output detecting portion is input for the purpose of buffering and amplifying, and through whose emitter the input is output to said amplifying portion.

14. A multi-output apparatus for projection TV lamp as claimed in claim 11, wherein said voltage dividing portion includes first and second resistors serially connected to the output stage of said DC/DC-voltage converter.

15. A multi-output apparatus for projection TV lamp as claimed in claim 11, wherein said lamp driving portion is constructed in such a manner that two pairs of transistors are driven in a push-pull fashion according to the driving pulse output from said driving pulse generator.

16. A multi-output apparatus for projection TV lamp as claimed in claim 11, wherein said voltage feeding-back portion comprises an operation amplifier for comparing the output voltage output from said voltage dividing portion with the reference voltage so that the voltage corresponding to their difference is output to said error amplifying portion.

17. A multi-output apparatus for projection TV lamp as claimed in claim 11, wherein said current feeding-back portion comprises an operation amplifier for comparing the current supplied with the reference voltage so that the voltage corresponding to their difference is output to said error amplifying portion.

18. A multi-output apparatus for projection TV lamp as claimed in claim 11, wherein said error amplifying portion comprises an operation amplifier for comparing the output voltages of said voltage feeding-back portion and current feeding-back portion with the reference voltage so as to output a voltage corresponding to their difference to said pulse-width modulation integrated device.

19. A multi-output apparatus for projection TV lamp as claimed in claim 11, wherein said amplifying portion comprises an operation amplifier for comparing the output voltage of said lamp output detecting portion with the reference voltage so as to output a voltage corresponding to their difference to said lamp output controller.

20. A multi-output apparatus for projection TV lamp as claimed in claim 11, wherein said lamp output controller comprises:

a zener diode whose anode is coupled to power source and whose cathode is coupled to the output port of said amplifying portion;

a first transistor whose collector is coupled to said power source, whose base is coupled to the cathode of said zener diode, and whose emitter is coupled to said lamp driving portion; and a second transistor whose emitter is coupled to the emitter of said first transistor, whose base is coupled to the output port of said amplifying portion, and whose collector is coupled to the ground.

* * * * *